US008667727B2

(12) United States Patent
Engelhardt

(10) Patent No.: US 8,667,727 B2
(45) Date of Patent: Mar. 11, 2014

(54) DEVICE FOR MOUNTING AN ADDITIONAL DEVICE TO A FIREARM

(75) Inventor: Michael Engelhardt, Nagold (DE)

(73) Assignee: IEA MIL-OPTICS GmbH, Nagold (DE)

( * ) Notice: Subject to any disclaimer, the term of this patent is extended or adjusted under 35 U.S.C. 154(b) by 0 days.

(21) Appl. No.: 13/416,054

(22) Filed: Mar. 9, 2012

(65) Prior Publication Data

US 2012/0227304 A1 Sep. 13, 2012

(30) Foreign Application Priority Data

Mar. 10, 2011 (DE) ..... 10 2011 013 575

(51) Int. Cl.
*F41G 1/387* (2006.01)

(52) U.S. Cl.
USPC ..... 42/124; 42/90; 42/125

(58) Field of Classification Search
USPC ..... 42/114, 142, 146, 90, 124, 125, 126, 42/127
See application file for complete search history.

(56) References Cited

U.S. PATENT DOCUMENTS

| | | | | |
|---|---|---|---|---|
| 5,425,191 | A * | 6/1995 | Taylor et al. | 42/124 |
| 6,722,074 | B1 * | 4/2004 | Farrell | 42/124 |
| 2004/0016169 | A1 * | 1/2004 | Poff, Jr. | 42/124 |
| 2009/0133309 | A1 * | 5/2009 | Cahill | 42/72 |
| 2009/0307956 | A1 * | 12/2009 | Barret | 42/125 |
| 2013/0008071 | A1 * | 1/2013 | Haering | 42/75.01 |

FOREIGN PATENT DOCUMENTS

| | | | | |
|---|---|---|---|---|
| DE | 2445230 A1 | | 4/1976 | |
| DE | 4133242 C1 | * | 10/1992 | F41G 1/387 |
| DE | 4133242 C1 | | 7/2008 | |

* cited by examiner

*Primary Examiner* — Michelle Clement
*Assistant Examiner* — John D Cooper
(74) *Attorney, Agent, or Firm* — Patent Central LLC; Stephan A. Pendorf

(57) ABSTRACT

A device for fixing an additional device, such as a scope or laser sighting device, to a firearm free of play and able to accommodate the ever-changing (recoil and spring-back) forces that occur on the engaging mechanism of the fixing device. In addition to a recoil lug contacting a first stop surface of a first groove, a further adjustable stop is provided, engaging a stop surface in a different groove in a direction opposite, along the line fire, to the first stop surface.

13 Claims, 10 Drawing Sheets direction of fire

DEVICE FOR MOUNTING AN ADDITIONAL DEVICE TO A FIREARM

BACKGROUND OF THE INVENTION

1. Field of the Invention

The invention concerns a device for fixing an additional device to a firearm. The invention in particular relates to a tip-up mounting unit for fastening a longitudinally adjustable stop with tight tolerance (free of play) and able to accommodate the ever-changing (recoil and spring-back) forces that occur on the engaging mechanism when shooting with automatic weapons.

2. Description of the Related Art

Scope mounts are used to assemble targeting devices, e.g., telescopes, on various firearms. Various types of mounts are known, including pivot mounts, claw mounts, fixed mounts, and tip-up mounts. Tip-up mounts are particularly common among the military types of scope mount. Especially popular are so-called Picatinny mounts, which have scope bases executed according to MIL-STD-1913. Therein the weapon is equipped with a Picatinny rail, which has transverse grooves for receiving a recoil lug. For manufacturing-technical reasons, these transverse grooves have relatively large tolerances in width (5.23 mm+0.23 mm). In the mass production of mounts it is thus not possible to precisely fit the recoil lugs to the transverse grooves. If the clamping force of the tip-up mount on the Picatinny rail is not enough, there results, as a consequence of the constantly changing forces when firing automatic weapons, a relative movement between the assembly and Picatinny rail due to the inertia of the mount plus telescopic sight. This leads to unwanted losses of accuracy when shooting, and a wearing-out of the assembly parts in the clamping area.

With a one-piece assembly, with only a single recoil lug, no way is yet know to compensate for this play. Two-piece assemblies, consisting of a front and a rear element, each of which being provided with a recoil lug, offer the possibility of engaging the recoil lugs in their respective grooves of the mount in opposing orientations, i.e., forwards and backwards. Therewith the free play can almost, but not completely, be ruled out. The securing of the mounting on the Picatinny rail is accordingly complicated. Moreover, when changing the assembly to a different Picatinny rail, the established precise positioning of the recoil lugs forwardly and rearwardly may no longer exist due to the tolerances of the groove widths.

BRIEF SUMMARY OF THE INVENTION

It is an object of the invention to develop a device for attaching an additional device to a firearm, which improves the positional stability of the attachment when using the firearm.

According to the invention, locking elements are provided in order to compensate for the free play in the direction of firing attributable to manufacturing tolerances, ensuring a longitudinally force-fitting seating between a mounted recoil lug and a corresponding groove in the rail. In the case of attaching the mounting assembly to other mounting rails, the close-tolerance fit (freedom from play) remains guaranteed.

The invention is particularly advantageously used when mounting a rifle scope, a laser sighting device, a lighting device or a night vision device onto a firearm, helmet, or other military or hunting equipment.

When seating a tip-up mount on a prism rail of a weapon, this is caused to abut foreword in the direction of firing via a recoil lug. In addition to this, a—manually adjustable or automatically adjustable—stop is brought to bear in the direction away from the direction of fire towards the rear. Thereby, the tip-up mount is fixed free from play in the direction of fire. The ever-changing forces occurring in the case of firing automatic weapons, namely in the direction of recoil and the subsequent return, are thus reliably absorbed and a forward or backward walking of the optics assembly can be ruled out. This is achieved in part by a movable and interlockingly acting additional stop, which, in a first embodiment, by means of a manually adjustable inclined sliding stop, is brought to bear in opposition to the direction of firing and therewith compensates for the tolerance-induced play of the recoil lug in its corresponding groove.

BRIEF DESCRIPTION OF THE DRAWINGS

This particularly advantageous embodiment of the invention will be explained in detail with reference to drawings.

In the drawings.

DETAILED DESCRIPTION OF THE INVENTION

The so-called Picatinny rail (10) according to MIL-STD-1913$^{th}$ has developed great popularity, especially in the military sphere, as an interface for attachment of targeting devices and accessories of all kinds. The Picatinny rail (10) consists of a rail (2) mounted in the direction of fire on the weapon and is provided on its upper side with a prism (6) extending in the direction of fire, which is used as an interface for receiving the targeting or auxiliary equipment (see FIG. 1 and FIG. 2). Introduced in this prism (6) are grooves (7) transverse to the direction of fire, which are, according to MIL-STD-1913, arranged at regular intervals of 10 mm.

Figure 1:
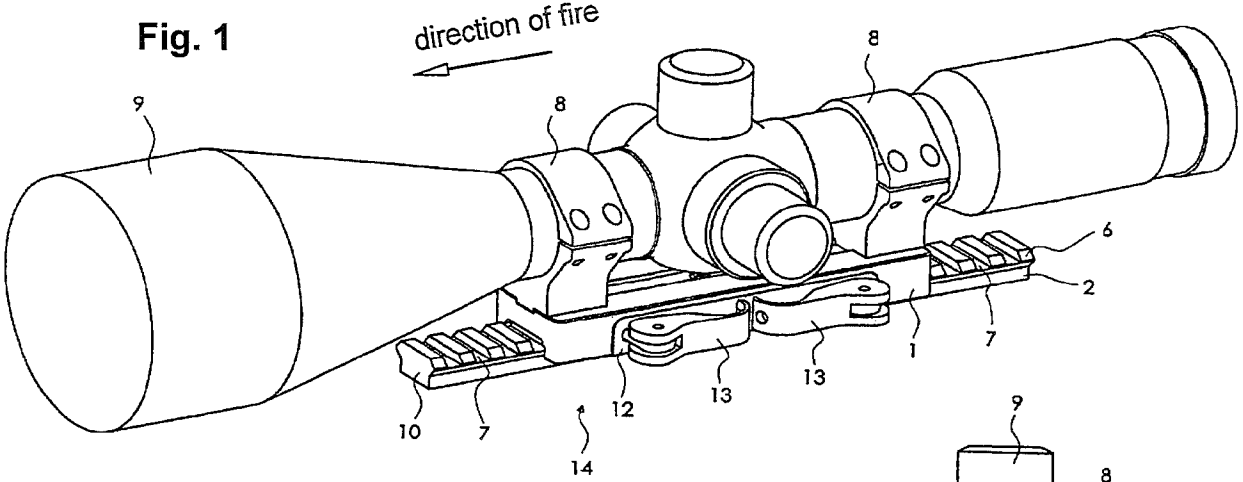
FIG. 1 is a perspective view of a telescopic sight mounted by a tip-up mount on a Picatinny rail.
Figure 2:
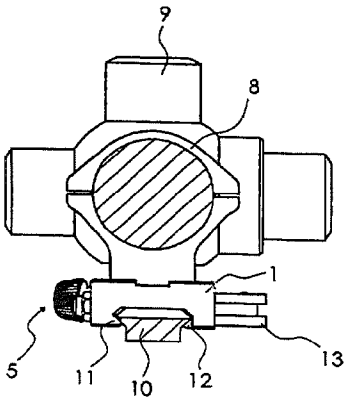
FIG. 2 is a sectional view of a telescopic sight mounted by a tip-up mount on a Picatinny rail in front view.

The tip-up mount (14) shown as an example in FIG. 1 consists of a base body (1), on which the receiving elements (8) are mounted, which receiving elements serve for fastening the telescopic sight (9). Receiving elements (8) and base body (1) can also be manufactured as one piece. In another possible embodiment of the invention, the base body (1) is made in two parts. The base body (1) of the tip-up mount (14) has, on its side facing the Picatinny rail (10), a fixed extension (11), which positively engages around a side of the prism (6) of the Picatinny rail (10) and thus align the base body (1) in the direction of fire. In addition, the base body (1) has a movable clamping element (12), which is pressed by the clamping lever (13) to the prism (6). The pressing can also be brought about using nuts or screws, wing nuts or thumb screws.

Figure 3:
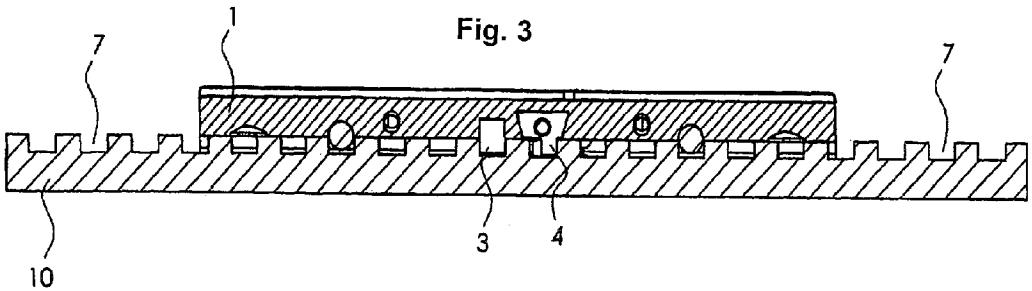
FIG. 3 is a sectional view of a base body of a tip-up mount mounted on a Picatinny rail.
Figure 4:
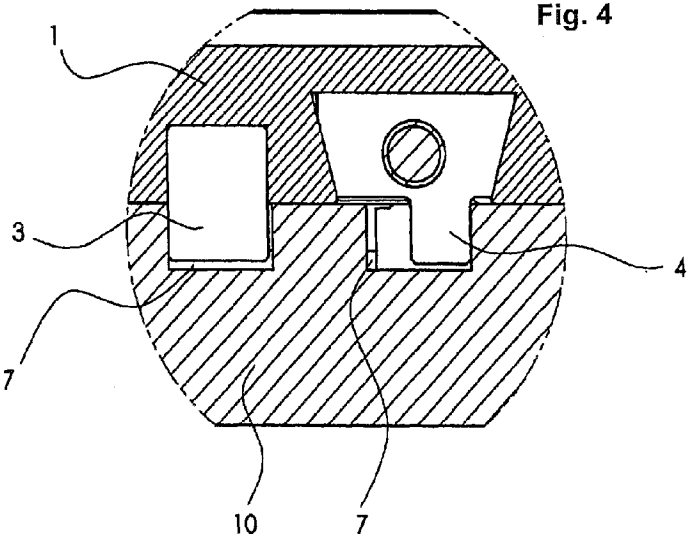
FIG. 4 shows an enlarged sectional view of the area of the recoil lug and the supplemental stop.
Figure 5:
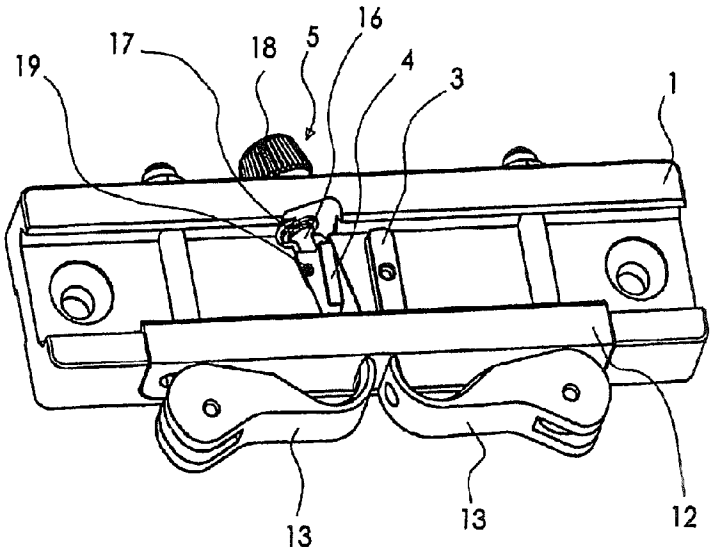
FIG. 5 is a perspective view of a base body in view obliquely from below.
Figure 6:
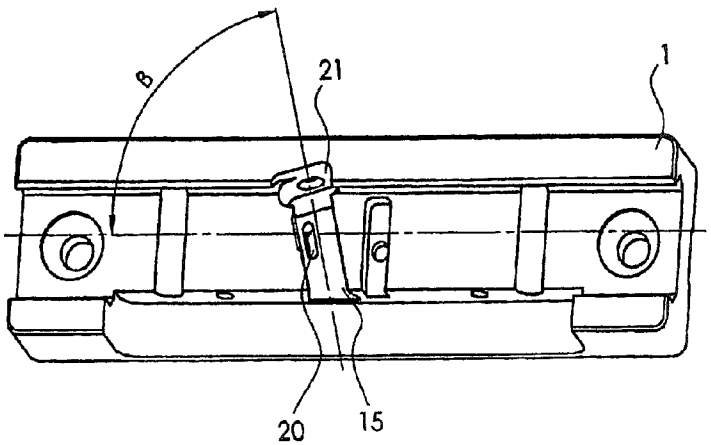
FIG. 6 is a perspective view of a base body in view obliquely from below, without additional stop and adjustment.

In order to fix the base body (1) in the direction of fire, a recoil lug (3) is provided on the underside of the base body, engaging into one of the grooves (7) and brought to rest towards the front in the direction of fire before closing the clamping levers (13) (see FIG. 3, FIG. 4 and FIG. 5). To compensate for the large amount of free play occurring between groove (7) and recoil lug (3) due to the manufacturing tolerances, an additional stop (4) is brought into contact in one of the grooves (7), in the direction opposite to the direction of fire, by means of the adjusting element (5) (see FIG. 4 and FIG. 5). The base body (1) has in its' Picatinny rail (10) facing side a prismatic recess (15), in which the additional stop (4) is displaceably guided (see FIG. 5 and FIG. 6). The orientation of the recess (15) is at an angle β greater than 0° and less than 90° to the direction of fire and the displacement plane or level of the additional stop (4) lies parallel to the underside of the base body (1) (see FIG. 6).

In a particularly advantageous embodiment of the invention, the adjusting element (5) is designed as a screw, whose head (18) for manual control is provided with a knurl (see FIG. 5). Its shaft (16) extends through a wall (21) of the base body (1) and is secured against displacement along the recess (15) using at least one securing element (17), preferably a shaft securing ring.

In another possible embodiment of the invention, the movable clamping element (12) serves as adjusting element whose movement, during the closing of the clamping lever (13), can be used for displacing the additional stop (4). The additional stop (4) is equipped with a stop element (19).

In a particularly advantageous embodiment of the invention, this stop element (19) is designed as a cutting or clamping sleeve (see FIG. 5). The base body (1) comprises a recess (20), into which the stop element (19) engages (see FIG. 6).

The two end positions of the additional stop (4) along its displacement path are thus defined and must meet the following conditions:

1) If the additional stop (4) is brought by the adjustment element (5) in one of the grooves (7) to rest against the direction of fire, the end position in this direction must be not yet be reached.

2) If the additional stop (4) is released via the adjustment element (5), its end position in this direction must be reached before reaching the stop in the direction of fire.

The tip-up mount can thus be removed without interference when it reaches the end position.

Figure 7:
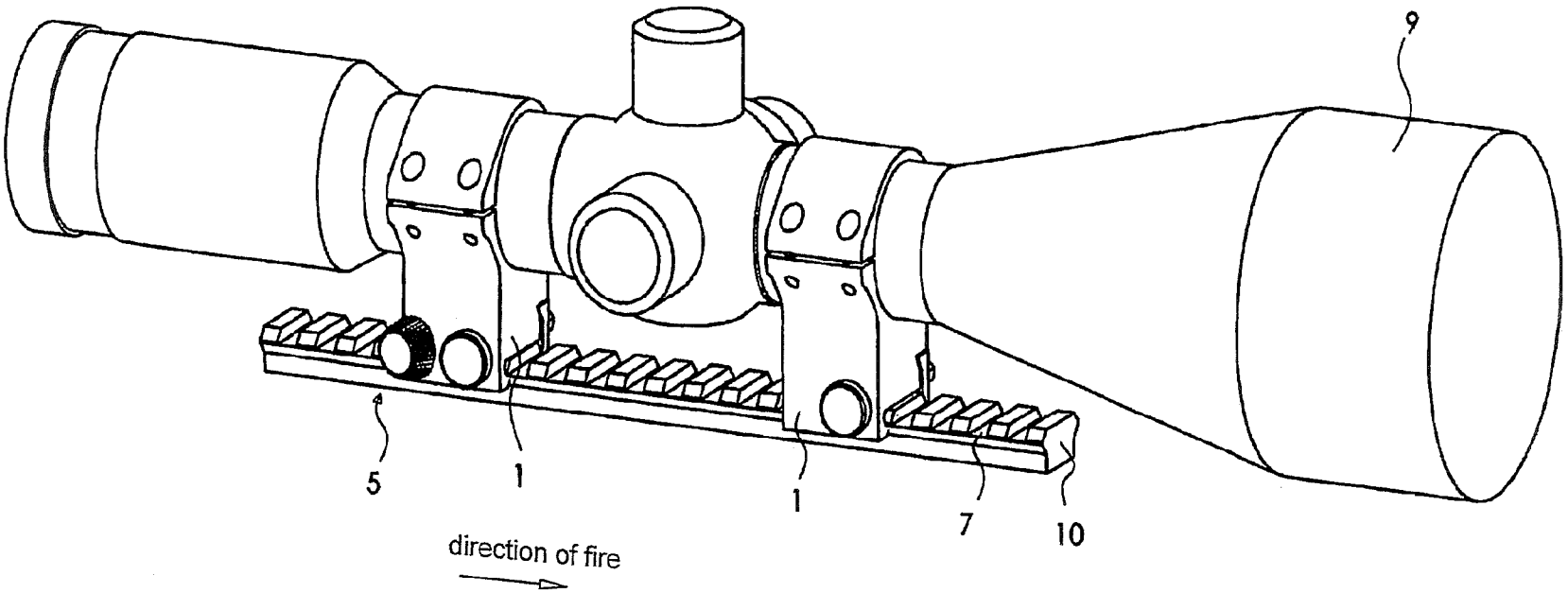
FIG. 7 is a perspective view of a two-part tip-up mount.

FIG. 7 shows an example of a possible embodiment of the invention with a two-part base (1). Therein only one of the two parts has, on its' Picatinny rail (10) facing side, a prismatic recess (15), in which the additional stop (4) is displaceably guided.

Figure 8:
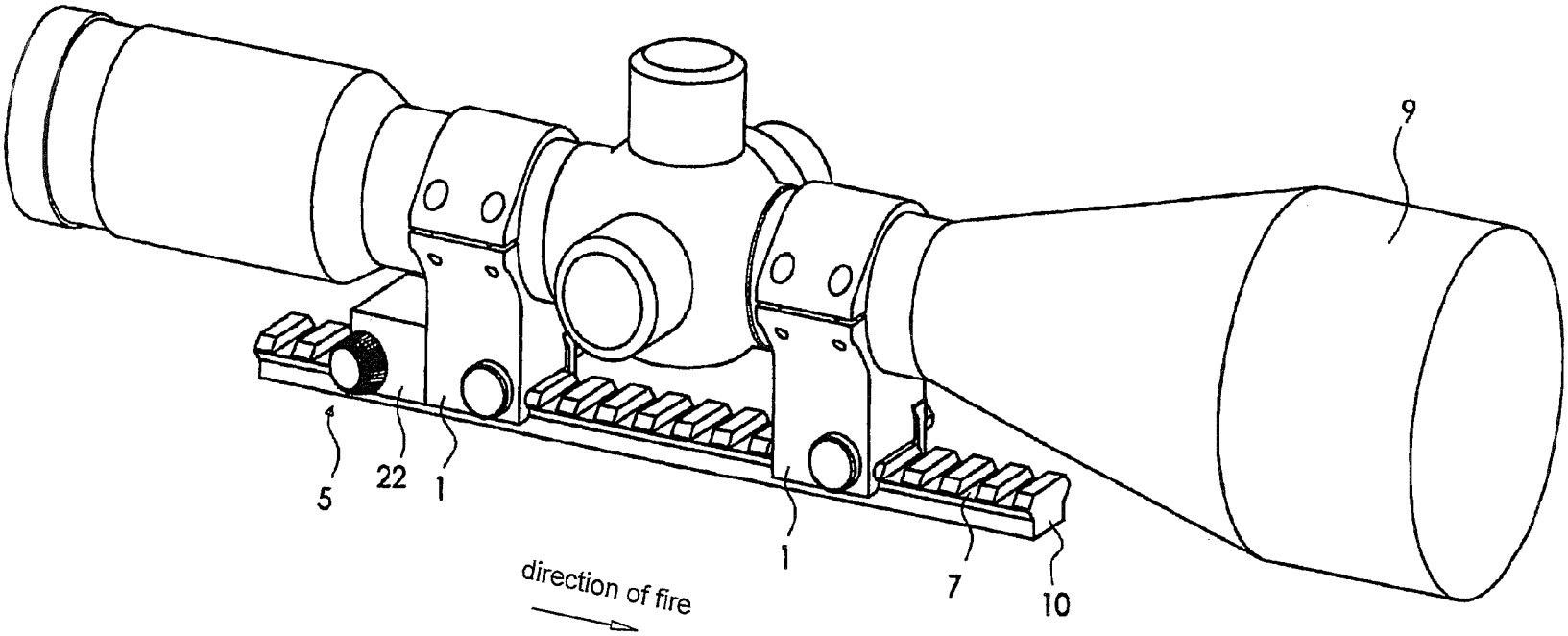
FIG. 8 is a perspective view of a two-part tip-up mount with an additional base body.

FIG. 8 shows an example of a possible embodiment of the invention with a two-part base (1). An additional base body (22) has, on its' side facing the Picatinny rail (10), a prismatic recess, in which the additional stop (4) is displaceably guided. The additional base body (22) may or may not, however, be mechanically connected with the base body (1). Through the contact of the additional stop (4), the additional base body (22) is pressed against the base body (1).

Figure 9:
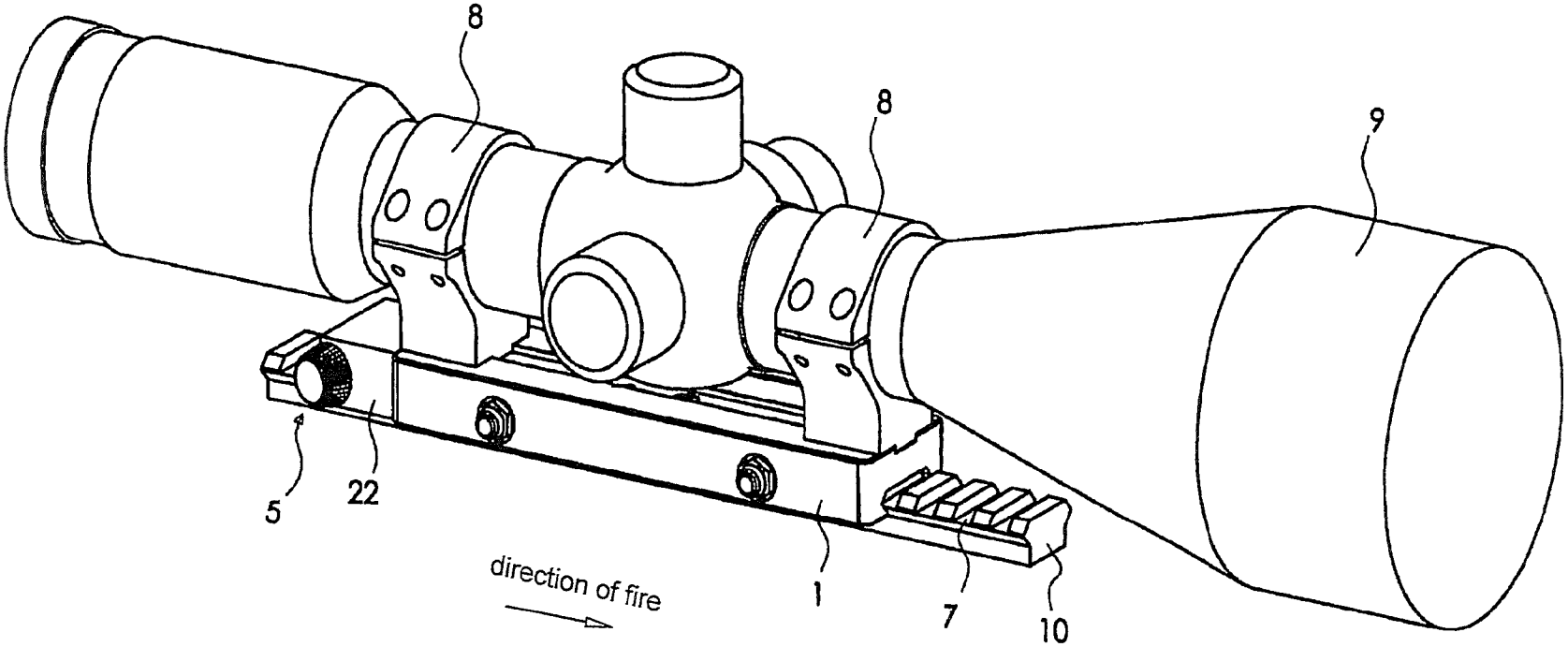
FIG. 9 is a perspective view of a one-piece tip-up mount with an additional base body.

FIG. 9 shows an example of a possible embodiment of the invention with one-piece base body (1) and also additional base body (22), whose execution corresponds with FIG. 7.

In a further embodiment of the invention, a spring-loaded pin serves as an additional stop, which pushes at an angle of between 0° and 90° against the wall of a groove in the Picatinny rail and thus compensates for the play between the recoil lug and groove.

This embodiment is explained in detail with reference to drawings.

Figure 10:
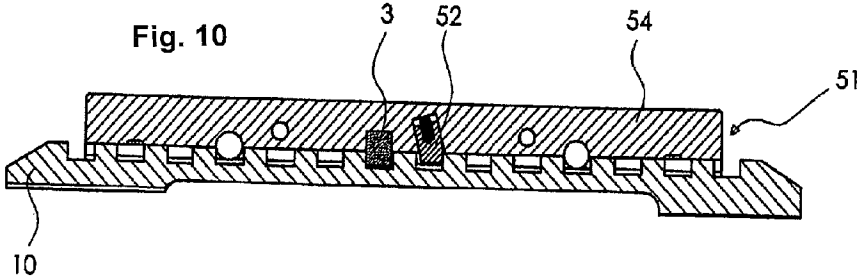
FIG. 10 is a sectional view of a base body of a second embodiment of a tip-up mount mounted on a Picatinny rail.
Figure 11:
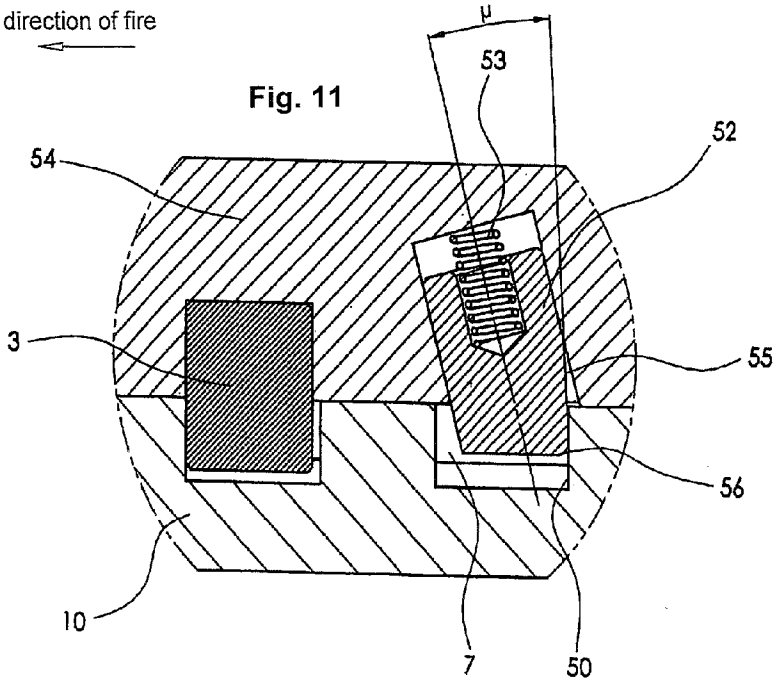
FIG. 11 is a greatly enlarged sectional view of a pin engaged in a groove of the Picatinny rail.
Figure 13:
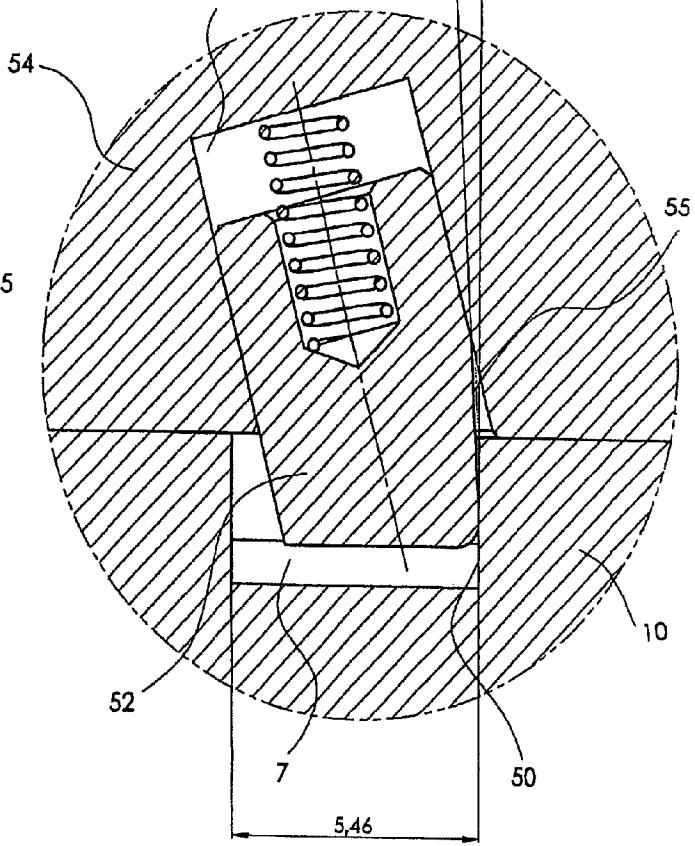
FIG. 13 is a greatly enlarged sectional view of a pin engaged in a groove with maximum dimension of tolerance to the groove width.
Figure 12:
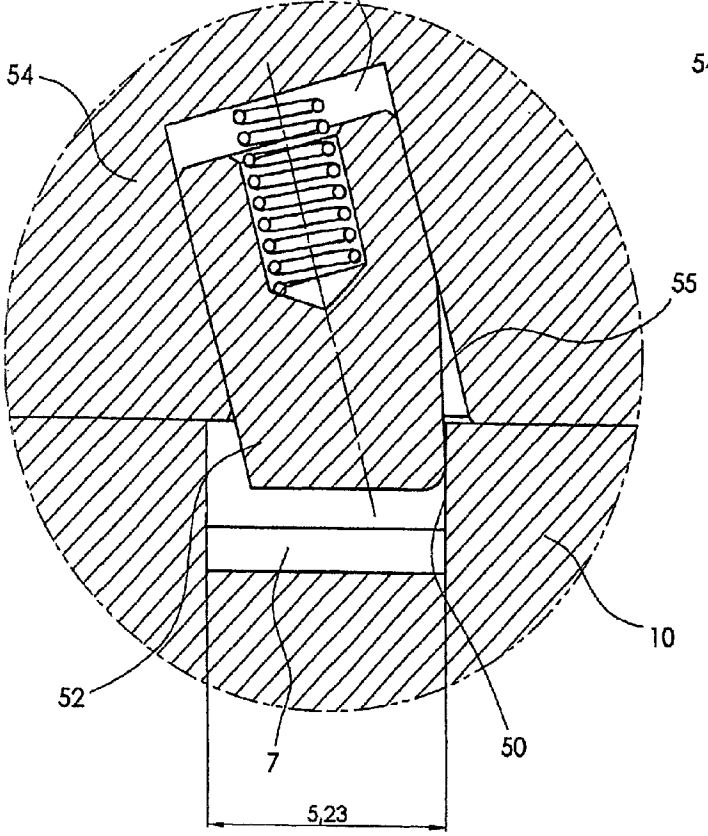
FIG. 12 shows a greatly enlarged sectional view of a pin engaged in a groove with minimum dimension of the tolerance of the slot width.
Figure 14:
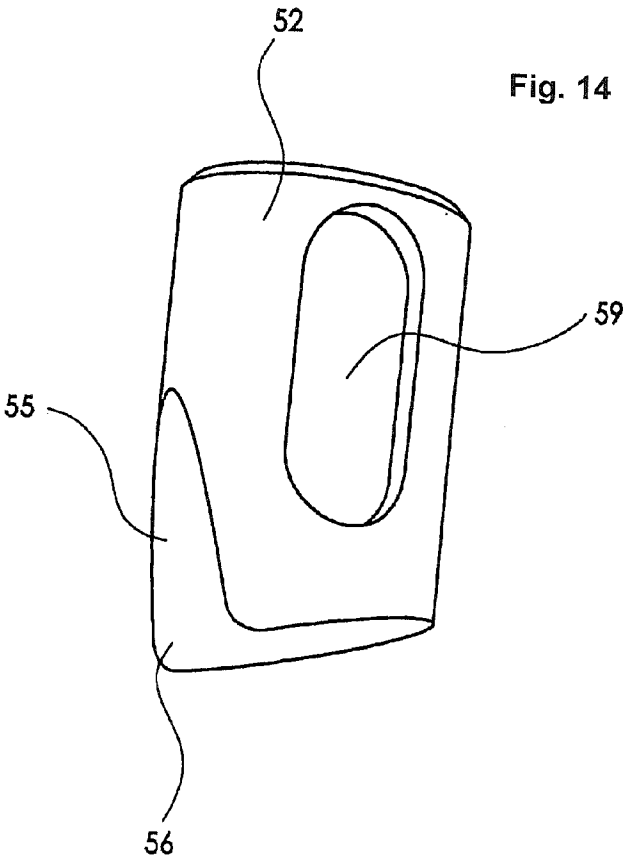
FIG. 14 is a pin in a spatial representation.
Figure 15:
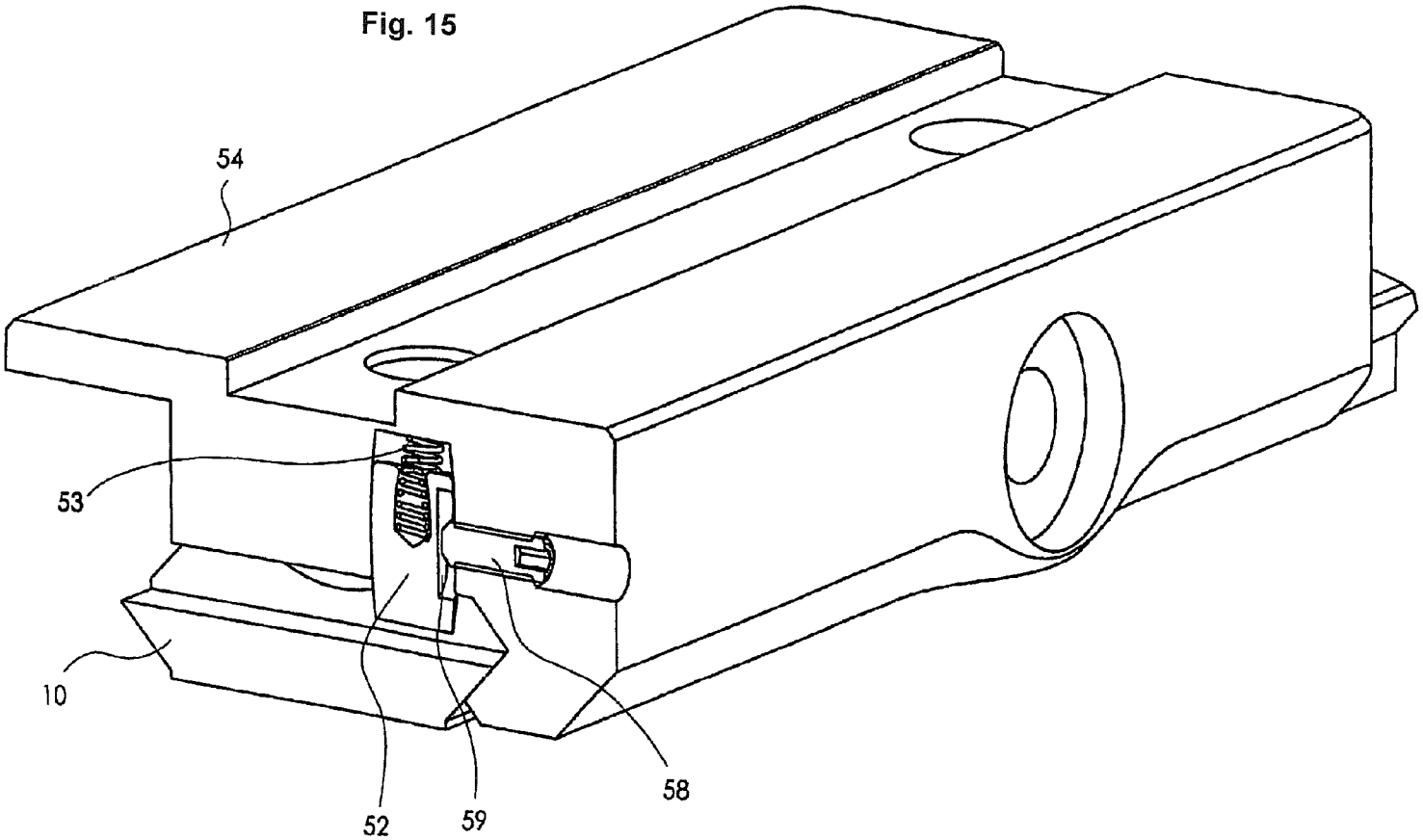
FIG. 15 is a sectional view showing a base body with pins and threaded pin for limiting the displacement path.

In the drawings FIG. 10 is a sectional view of a base body of a tip-up mount mounted on a Picatinny rail, FIG. 11 is a greatly enlarged sectional view of a pin engaged in a groove of the Picatinny rail, FIG. 12 shows a greatly enlarged sectional view of a pin engaged in a groove with minimum dimension of the tolerance of the slot width, FIG. 13 is a greatly enlarged sectional view of a pin engaged in a groove with maximum dimension of tolerance to the groove width, FIG. 14 is a pin in a spatial representation, and FIG. 15 is a sectional view showing a base body with pins and threaded pin for limiting the displacement path.

The structure of the second embodiment of the tip-up mount (51) corresponds substantially to the tip-up mount (14) of the previous embodiment. Here a cylindrical pin (52) serves substantially as an additional stop, which is urged by the compression spring (53) against the wall (50) of one of the grooves (7) when seated on the Picatinny rail (10) and thus bring the recoil lug (3) into engagement forward in the direction of fire (see FIG. 10).

In a further embodiment, the pin (52) may have any other shape, for example substantially rectangular. Also, several springs can also be used. Also, instead of the compression spring, a leaf spring can be used.

The displacement of the pin (52) runs at an angle μ greater than 0° and less than 90°, preferably 15°. The contact surface (55) of the pin (52) compensates for this angle again. Thus, the contact surface (55) lies flat against the wall (50). To protect the edges of the groove (7), the pin (52) is provided with a radius (56) (see FIG. 11).

In another possible embodiment, the contact surface (55) forms an α to the wall (50) (see FIG. 13). Thereby the pin (52) lies with its radius (56) against the wall (50). If the displacement path of the pin (52) were to extend vertically and if this were to exhibit an inclined bearing surface compared to the abutment surface (55), then the contact would essentially be a line against the groove (7). This would inevitably lead to compressive deformation, leading to damage to the rail.

FIGS. 12 and 13 show the arrangement of the contact surface (55) of the pin (52) against the wall (50) in the case of the smallest or the largest dimension of the tolerance of the width of the groove (7). The displacement path of the pin (52) in both directions is limited in such a manner that the pin (52) upon contact of the contact surface (55) against the wall (50) in the case of the minimum dimension of the tolerance of the groove (7) still has travel room to the base of the bore (57) (see FIG. 12). At maximum dimension of the tolerance of the groove (7), the pin (52) with contact surface (55) on the wall (50) has not been reached it's maximum travel (see FIG. 13).

The limitation of the travel of the displacement path of the pin (52) in the working direction of the compression spring (53) is brought about by a threaded pin (58), which engages in the slot (59) in the pin (52) (see FIGS. 14 and 15). The threaded pin (58) can also be designed as a clamping sleeve, straight pin, or any other suitable component.

In a further, not illustrated, embodiment of the invention, a manually actuated eccentric shaft serves as an additional stop, which is guided in the base body of the tip-up mount and is operated by a lever element or by means of a tool and is engaged vertically or horizontally in one of the grooves of the Picatinny rail. By rotating the eccentric shaft, this comes to press against one of the walls of the Picatinny rail and thus brings the recoil lug to bear.

LIST OF REFERENCE NUMERALS

1. Body
2. Rail
3. Recoil lug
4. Additional stop
5. Adjusting element
6. Prism
7. Groove
8. Receiving member
9. Scope
10. Picatinny rail
11. Fixed extension
12. Movable clamping element
13. Clamping lever
14. Tip-up mount
15. Prismatic recess
16. Shank
17. Securing element
18. Head
19. Stop element
20. Recess
21. Wall
22. Additional base
50. Wall of the groove
51. Second embodiment of the tip-up mount
52. Pin
53. Compression spring
54. Second embodiment of the body
55. Contact surface
56. Radius
57. Bore
58. Screw
59. Slot

The invention claimed is:

1. A device for attaching an additional device to a firearm, with a rail (2, 10), which can be attached to the firearm, and which exhibits multiple grooves (7) transverse to the direction of fire, each of which grooves having side surfaces serving as stop surfaces, and a mount assembly (1, 22, 54), including elements (8) for holding the additional device (9) and means (12, 13) for releasably clamping the assembly (1, 22, 54) onto the rail (2, 10), including a recoil lug (3) dimensioned to fit into a first groove (7) on the mounting assembly (1, 12, 13, 22, 54) and rest against a first stop surface of a first groove (7), wherein the mount assembly (1, 22, 54) further includes an adjustable stop (4, 19, 52) lying without play against a stop surface (50) of a further groove (7) opposite, along the line of fire, to the first stop surface, and wherein the adjustable stop is a pin (52) urged by the force of a spring (53) to rest against the stop surface (50) of the further groove (7).

2. The device according to claim 1, wherein the stop (4, 19) is displaceable in a groove (15) of the mount (1) with an adjustment element (5, 13), and wherein the groove (15) lies at an acute angle (13) to the direction of fire.

3. The device according to claim 1, wherein the stop (4) is an eccentric shaft which is rotatably mounted on the mount assembly (1, 22, 54).

4. The device according to claim 1, wherein the mounting assembly is a multi-part assembly (1, 22, 54), and that the recoil lug (3) is provided in one part (1) and the stop (4) is provided in another part (22).

5. The device according to claim 1, wherein the end positions of the stop (4, 19, 52) are fixed.

6. The device according to claim 1, wherein said transverse grooves repeat at regular intervals of 10 mm.

7. The device according to claim 1, wherein said stop surface (50) is perpendicular to the direction of fire.

8. The device according to claim 1, wherein said rail (2, 10) is a Picatinny rail.

9. A device for attaching an additional device to a firearm, with a rail (2, 10), which can be attached to the firearm, and which exhibits multiple grooves (7) transverse to the direction of fire, each of which grooves having side surfaces serving as stop surfaces, and a mount assembly (1, 22, 54), including elements (8) for holding the additional device (9) and means (12, 13) for releasably clamping the assembly (1, 22, 54) onto the rail (2, 10), including a recoil lug (3) dimensioned to fit into a first groove (7) on the mounting assembly (1, 12, 13, 22, 54) and rest against a first stop surface of a first groove (7), wherein the mount assembly (1, 22, 54) further includes an adjustable stop (4, 19, 52) lying without play against a stop surface (50) of a further groove (7) opposite, along the line of fire, to the first stop surface, wherein the stop (4, 19) is displaceable in a groove (15) of the mount (1) with an adjustment element (5, 13) and wherein the groove (15) lies at an acute angle (β) to the direction of fire, and wherein the adjusting element is an eccentric clamping lever (13) for clamping the mount (1) on the rail (2, 10).

10. The device according to claim 9, wherein, as the adjusting element, an adjusting screw (5) is provided on the mount (1), of which the adjustment thread is in a threaded bore of the stop (4, 19).

11. The device according to claim 10, wherein the screw (5) is secured against displacement in the direction of the groove (15).

12. A device according to claim 9, wherein the stop is a pin (52) which, urged by the force of a spring (53), rests against the stop surface (50) of the further groove (7).

13. A device for attaching an additional device to a firearm, with a rail (2, 10), which can be attached to the firearm, and which exhibits multiple grooves (7) transverse to the direction of fire, each of which grooves having side surfaces serving as stop surfaces, and a mount assembly (1, 22, 54), including elements (8) for holding the additional device (9) and means (12, 13) for releasably clamping the assembly (1, 22, 54) onto the rail (2, 10), including a recoil lug (3) dimensioned to fit into a first groove (7) on the mounting assembly (1, 12, 13, 22, 54) and rest against a first stop surface of a first groove (7), wherein the mount assembly (1, 22, 54) further includes an adjustable stop (4, 19, 52) lying without play against a stop surface (50) of a further groove (7) opposite, along the line of fire, to the first stop surface, wherein the stop is a pin (52) urged by the force of a spring (53) to rest against the stop surface (50) of the further groove (7), and wherein the cylindrical pin (52) is guided in a bore of the mount (54), which lies inclined at an acute angle (μ) to the stop surface (50).

* * * * *